US007462435B2

(12) United States Patent
Hagino

(10) Patent No.: US 7,462,435 B2
(45) Date of Patent: Dec. 9, 2008

(54) METHOD OF PRODUCING POLYMERIZED TONER

(75) Inventor: Akihide Hagino, Tokyo (JP)

(73) Assignee: Zeon Corporation, Tokyo (JP)

( * ) Notice: Subject to any disclaimer, the term of this patent is extended or adjusted under 35 U.S.C. 154(b) by 408 days.

(21) Appl. No.: 11/443,017

(22) Filed: May 31, 2006

(65) Prior Publication Data

US 2006/0269866 A1 Nov. 30, 2006

(30) Foreign Application Priority Data

May 31, 2005 (JP) ..... 2005-160747

(51) Int. Cl.
*G03G 5/00* (2006.01)

(52) U.S. Cl. ..... 430/137.15

(58) Field of Classification Search ..... 430/137.15
See application file for complete search history.

(56) References Cited

U.S. PATENT DOCUMENTS 3,014,810 A * 12/1961 Dybalski et al. ..... 106/453
3,644,590 A * 2/1972 Coulthard ..... 428/36.8
3,652,518 A * 3/1972 Kawasaki et al. ..... 526/114
4,493,787 A * 1/1985 Taniguchi et al. ..... 252/511
5,912,304 A * 6/1999 Novits et al. ..... 525/245

FOREIGN PATENT DOCUMENTS

| | | |
|---|---|---|
| JP | 5-100484 | 4/1993 |
| JP | 2004-302239 | 10/2004 |
| WO | WO 02/077717 A1 | 10/2002 |

* cited by examiner

*Primary Examiner*—Hoa V Le
(74) *Attorney, Agent, or Firm*—Westerman, Hattori, Daniels & Adrian, LLP.

(57) ABSTRACT

The present invention aims to provide a method of producing a polymerized toner which is small in an amount of a microparticle produced as a by-product and an amount of a polymerizable monomer remained, generates no filming upon printing and is excellent in printing durability, and provides a method of producing a polymerized toner comprising the steps of: (A) preparing a polymerizable monomer composition containing at least a polymerizable monomer and a colorant; (B) obtaining a polymerizable monomer composition dispersion by adding the polymerizable monomer composition in an aqueous medium containing a dispersion stabilizer, thereby to form droplets of the polymerizable monomer composition; and (C) obtaining a colored polymer particle by heating the polymerizable monomer composition dispersion to polymerize the polymerizable monomer composition, wherein the polymerizable monomer composition dispersion contains a water-soluble polymerization inhibitor and a thiuram disulfide.

11 Claims, 1 Drawing Sheet

METHOD OF PRODUCING POLYMERIZED TONER

BACKGROUND OF THE INVENTION

1. Field of the Invention

The present invention relates to a method of producing a polymerized toner for developing a latent image of electrostatics (hereinafter, it may be simply referred as "a toner") used for development of a latent image of electrostatics in an electrophotography, an electrostatic recording method, an electrostatic printing process or the like. Particularly, the present invention relates to a method of producing a polymerized toner which is small in an amount of a microparticle produced as a by-product and an amount of a polymerizable monomer remained and is excellent in printing durability.

2. Description of the Related Art

An electrophotography is a method of obtaining a printed product in such a manner that a latent image of electrostatics formed on a photosensitive member is developed by a toner comprising a colored polymer particle, and if required, other particles such as an external additive, a carrier, or the like, the toner is transferred to a transferring material such as paper, an OHP sheet or the like, and the transferred toner is fixed on the transferring material. As a method of development using a toner or a method of fixing a printed image of a toner, conventionally various kinds of methods has been proposed. A method suitable for requirement of forming an image is selected.

Recently, the need of colorization for image-forming devices such as copying machines, facsimiles printers or the like is increasing. Since in color printing, an image requiring high resolution and reproduction of a clear color tone such as a photograph or the like is also printed, a colored toner which can suffice such requirements is needed.

As for the toner, various properties are required such as environmental stability from the viewpoint of preventing deterioration of an image quality due to environmental changes such as temperature, humidity or the like, printing durability (property to be able to endure continuous printing, that is, property that problems such as filming, generation of vertical stripes, generation of fog and the like do not occur to a printing device, a printed product or the like when printing is performed continuously) from the viewpoint of reduction in toner consumption, low-temperature fixing ability from the viewpoint of reduction of an electric power consumption, or the like.

In order to increase resolution of a printed product to be obtained, since both excellent transferability and dot reproducibility can be attained, a spherical toner having a small particle diameter is suitable. As a method of producing such a toner, a polymerization method is proposed.

In a conventional pulverization method, particularly, when a toner having a small particle diameter is produced, yield decreases and much energy is consumed for pulverization. To the contrary, a polymerization method is high in yield, consumption energy is low as the pulverization process is not required, and further a spherical toner can be easily produced.

Among the methods for producing a toner (a polymerized toner) by the polymerization method, a suspension polymerization method is widely utilized. In the suspension polymerization method, firstly, a polymerizable monomer, a colorant, a charge control resin, and if required, other additives are mixed to prepare a polymerizable monomer composition, and the polymerizable monomer composition is dispersed in an aqueous medium containing a dispersion stabilizer. Next, high shear is applied to the aqueous medium having the polymerizable monomer composition dispersed by means of a high-speed agitator or the like to form a droplet of the polymerizable monomer composition. Then, the aqueous medium having the polymerizable monomer composition dispersed and having the droplet formed is polymerized in the presence of a polymerization initiator followed by filtration using a filter, washing and drying, thus, a colored polymer particle is obtained. Further, the colored polymer particle is mixed, if required, with a carrier and/or an external additive such as an inorganic microparticle or the like to obtain a polymerized toner.

It is a problem of the method of producing the polymerized toner that a microparticle having a submicron order particle diameter is produced as a by-product upon polymerization to obtain the colored polymer particle besides a desired colored polymer particle (hereinafter, the microparticle produced as a by-product may be referred as "a by-product microparticle"). If the microparticle is produced as a by-product, a part of the microparticles released clogs the filter upon filtration of the obtained colored polymer particle from the aqueous medium. Hence, a filtration rate decreases.

Also, if a polymerized toner is produced from the colored polymer particle containing a lot of by-product microparticles and the polymerized toner is used for printing, the by-product microparticle is likely to adhere to members in a developer since the by-product microparticle is significantly small in particle diameter and thereby has high adherence. When plural prints are printed using the polymerized toner, the attached by-product microparticle is gradually accumulated so as to cause filming (adherence) to the member. When the by-product microparticle causes filming on a developing blade or a sealing member between a developing roll and a toner container, an even toner layer cannot be formed on the developing roll so that vertical stripes are likely to be generated on an image. If filming is caused on the developing roll or the photosensitive member, a fog is generated on a transferring material such as paper or the like to cause decrease in durability of the toner. Hence, development of a method to inhibit production of such a microparticle as a by-product is desired.

In order to satisfy such various demands of properties including the environmental stability, the printing durability, the low-temperature fixing ability and so on, and the prevention of microparticle produced as a by-product, further insights are provided into a method of forming an image and a toner used therefore.

Firstly, WO2002/077717 can be exemplified. WO2002/077717 discloses a method of producing a toner, in which a polymerizable monomer composition containing a polymerizable monomer and a colorant is polymerized in an aqueous medium in the presence of a compound "A" selected from the group consisting of (1) a thiazole thio compound , (2) a thiuram compound (particularly, thiuram disulfide) and (3) a dithio carbamate compound, proposed for the purpose of stable production of a toner which is excellent in a balance between fixing ability and shelf stability and can form a clear image, particularly in the case of a colored toner, for the purpose of production of a toner excellent in a sharp melt property required for reproduction of a clear color tone of a color image. However, the prevention of microparticle as a by-product is not taken into account in WO2002/077717 and the method is insufficient in the effect of inhibiting production of a microparticle as a by-product according to the result of research done by the inventor of the present invention (not disclosed). Also, the amount of polymerizable monomer remained in the toner is large.

Next, as a method to inhibit production of the microparticle as a by-product, a method of producing a toner using a specific azo compound as a polymerization initiator and a hydroquinone based compound as a polymerization inhibitor is proposed (Japanese Patent Application Laid-Open (JP-A) No. 2004-302239). However, the method is insufficient in the effect of inhibiting production of the microparticle as a by-product.

Also, a method to produce a toner, in which a polymerizable monomer composition containing a radical polymerizable monomer as a polymerizable monomer, a colorant and a radical polymerization inhibitor soluble to the radical polymerizable monomer and soluble to an alkali aqueous medium as other additive is suspended in an alkali aqueous medium followed by polymerization, is proposed (JP-A No. 5-100484). However, the method is insufficient in the effect to inhibit production of the microparticle as a by-product. Even further, the durability of the toner is inferior. Furthermore, there is a problem of generation of an odor upon printing due to the polymerizable monomer such as styrene, a decomposed product of a polymerization initiator or the like remained in the toner. If there is a large amount of the polymerizable monomer or the like remained in the toner, a component such as a wax or the like present in the toner may exude on the surface of the toner during storage besides the problem of the odor. It causes a problem that aggregation of the toner further increases and filming to a photosensitive member or the like is more likely to be generated.

An object of the present invention is to provide a method of producing a polymerized toner which is small in an amount of a microparticle produced as a by-product and an amount of a polymerizable monomer remained, generates no filming upon printing and is excellent in printing durability.

SUMMARY OF THE INVENTION

As the result of diligent researches made to attain the above object, the inventor of the present invention found out that a preferable result can be obtained when a polymerizable monomer composition dispersion contains both water-soluble polymerization inhibitor and thiuram disulfide in a method of producing a polymerized toner, and completed the present invention based on the above knowledge.

That is, a method of producing a polymerized toner of the present invention comprises the steps of:

(A) preparing a polymerizable monomer composition containing at least a polymerizable monomer and a colorant;

(B) obtaining a polymerizable monomer composition dispersion by adding the polymerizable monomer composition in an aqueous medium containing a dispersion stabilizer, thereby to form droplets of the polymerizable monomer composition; and (C) obtaining a colored polymer particle by heating the polymerizable monomer composition dispersion to polymerize the polymerizable monomer composition, wherein the polymerizable monomer composition dispersion contains a water-soluble polymerization inhibitor and a thiuram disulfide.

When the polymerizable monomer composition dispersion contains both water-soluble polymerization inhibitor and the thiuram disulfide, the amount of a by-product microparticle in the toner is small and the amount of a remained polymerizable monomer can be suppressed.

The water-soluble polymerization inhibitor is preferably a hydroquinone. When the thiuram disulfide is used in combination with the hydroquinone, the effect of inhibiting generation of the by-product microparticle is high and the amount of the remained polymerizable monomer does not increase.

In the above method of producing a polymerized toner, it is preferable that the polymerizable monomer composition contains the thiuram disulfide. In comparison with a case adding the thiuram disulfide in the step (B) or later, when the thiuram disulfide is preliminarily added upon preparing the polymerizable monomer composition, the thiuram disulfide is evenly contained in a droplet of the polymerizable monomer composition, the effect to inhibit generation of the by-product microparticle in the toner is high, and the amount of the remained polymerizable monomer in the toner is small.

Also, it is preferable that the water-soluble polymerization inhibitor is added to the polymerizable monomer composition dispersion after the step (B) and before the step (C). When the water-soluble polymerization inhibitor is added at such a time, the suppressing effect of the amount of the by-product microparticle and the amount of the remained polymerizable monomer is high.

BRIEF DESCRIPTION OF THE DRAWING

In the accompanying drawing.

DETAILED DESCRIPTION OF THE INVENTION

Figure 1:
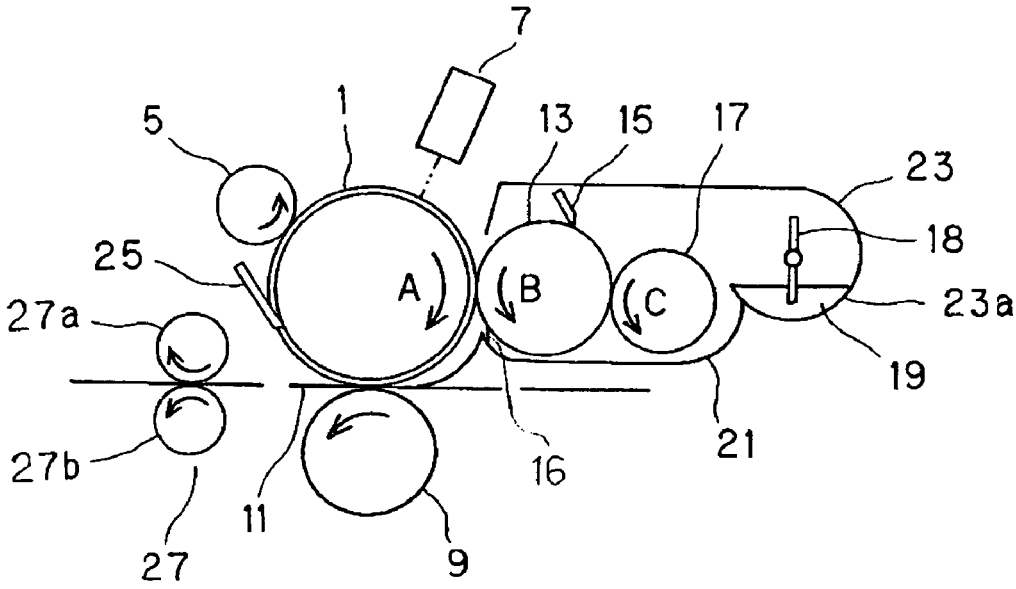
FIG. 1 is a view showing a constitutional example of an image forming device, to which a polymerized toner of the present invention is applied.

A method of producing a polymerized toner of the present invention comprising the steps of:

(A) preparing a polymerizable monomer composition containing a polymerizable monomer and a colorant;

(B) obtaining a polymerizable monomer composition dispersion by adding the polymerizable monomer composition in an aqueous medium containing a dispersion stabilizer, thereby to form a droplet of the polymerizable monomer composition; and (C) obtaining a colored polymer particle by heating the polymerizable monomer composition dispersion to polymerize the polymerizable monomer composition, wherein the polymerizable monomer composition dispersion contains a water-soluble polymerization inhibitor and a thiuram disulfide.

In a method of producing a toner, a lot of by-product microparticles are attached to the surface of a particle of a toner obtainable from a dispersion of a polymerizable monomer composition not containing a water-soluble polymerization inhibitor but containing a thiuram disulfide. If continuous printing is performed using the toner having a lot of by-product microparticles attached, filming of the by-product microparticle is likely to occur. As a result, problems such as generation of vertical stripes on a printed product and the like may be raised.

On the other hand, a lot of by-product microparticles are attached to a particle of a toner obtainable from a dispersion of a polymerizable monomer composition not containing a thiuram disulfide but containing a water-soluble polymerization inhibitor, and the same problems may be raised.

Also, if the water-soluble polymerization inhibitor is excessively used in order to reduce number of the by-product microparticle on the surface of the toner, the number of the by-product microparticle decreases, however, a polymerization reaction may be inhibited so that the remaining amount of the polymerizable monomer such as styrene or the like in the toner increases. When such a toner is used for printing, an odor may be generated. Also, if an amount of the remained polymerizable monomer is large, aggregation of the toner during storage may be increased and filming or the like may be more likely to be generated on a photosensitive member or a developing blade upon continuous printing.

To the contrary, when a polymerizable monomer composition dispersion contains both water-soluble polymerization inhibitor and thiuram disulfide, more preferably when the thiuram disulfide is mainly present in a droplet of a polymerizable monomer composition and the water-soluble polymerization inhibitor is mainly present in an alkali aqueous medium, a particle of a toner in which the number of the by-product microparticle in the toner and the amount of the remained polymerizable monomer are small can be obtained.

Hereinafter, a method of producing a toner of the present invention will be explained in order.

(1) Process (A) of Preparing a Polymerizable Monomer Composition

Firstly, a polymerizable monomer composition is prepared by mixing a polymerizable monomer, a colorant, and if required, other additives.

The polymerizable monomer in the present invention means a polymerizable compound.

As a main component of the polymerizable monomer, a monovinyl monomer is preferably used. As the monovinyl monomer, for example, there may be styrene; a styrene derivative such as vinyl toluene, α-methyl styrene or the like; acrylic acid and methacrylic acid; acrylic acid ester such as methyl acrylate, ethyl acrylate, propyl acrylate, butyl acrylate, 2-ethylhexyl acrylate, dimethylaminoethyl acrylate or the like; methacrylic acid ester such as methyl methacrylate, ethyl methacrylate, propyl methacrylate, butyl methacrylate, 2-ethylhexyl methacrylate, dimethylaminoethyl methacrylate or the like; an unsaturated nitrile compound such as acrylonitrile, methacrylonitrile or the like; an unsaturated amide compound such as acrylamide, methacrylamide or the like; olefin such as ethylene, propylene, butylene or the like; vinyl halide or vinylidene halide such as vinyl chloride, vinylidene chloride, vinyl fluoride or the like; vinyl ester such as vinyl acetate, vinyl propionate or the like; vinyl ether such as vinyl methyl ether, vinyl ethyl ether or the like; vinyl ketone such as vinyl methyl ketone, methyl isopropenyl ketone or the like; a nitrogen-containing vinyl compound such as 2-vinylpyridine, 4-vinylpyridine, N-vinylpyrrolidone or the like. The above monovinyl monomers may be used alone or in combination thereof. Among them, the styrene, the styrene derivative, acrylic acid ester, and methacrylic acid ester may be suitably used as the monovinyl monomer.

It is preferable that the monovinyl monomer is selected so that a polymer obtainable by polymerizing the monovinyl monomers has a glass transition temperature (hereafter it may be referred as "Tg") of 80° C. or less. By using the monovinyl monomer alone or in combination of two or more kinds, Tg of the polymer to be obtained can be adjusted in a desired range.

In order to prevent hot offset, any crosslinkable polymerizable monomer may be preferably used together with the monovinyl monomer. The crosslinkable polymerizable monomer means a monomer having two or more polymerizable functional groups. As the crosslinkable polymerizable monomer, for example, there may be an aromatic divinyl compound such as divinyl benzene, divinyl naphthalene, a derivative thereof or the like; a diacrylate compound and a derivative thereof such as ethylene glycol dimethacrylate, diethylene glycol dimethacrylate or the like; other divinyl compound such as N,N-divinylaniline, divinyl ether or the like; a compound containing three or more vinyl groups or the like. The crosslinkable polymerizable monomer may be used alone or in combination of two or more kinds.

In the present invention, it is desirable that the ratio of the crosslinkable polymerizable monomer is generally from 0.1 to 5 parts by weight, preferably from 0.3 to 2 parts by weight, with respect to the monovinyl monomer contained in the polymerizable monomer of 100 parts by weight.

Also, it is preferable to use a macromonomer as a part of the polymerizable monomer a balance between prevention of blocking at storage and lowering of fixing temperature of a polymerized toner to be obtained improves. The macromonomer is a monomer having a polymerizable carbon-carbon unsaturated double bond at the end of a molecular chain, which is an oligomer or polymer generally having a number average molecular weight from 1,000 to 30,000.

As the macromonomer, a macromonomer which forms a polymer having higher Tg when polymerized than that of a polymer obtained by polymerizing the monovinyl monomer alone, is preferable. The amount of the macromonomer may be generally from 0.01 to 10 parts by weight, preferably from 0.03 to 5 parts by weight, more preferably from 0.05 to 1 part by weight, with respect to the monovinyl monomer contained in the polymerizable monomer of 100 parts by weight.

In the present invention, a colorant may be used. In the case of producing a colored toner, wherein there may be generally a black toner, a cyan toner, a yellow toner and a magenta toner, a black, cyan, yellow or magenta colorant may be respectively used.

In the colorant of the present invention, as a black colorant, there may be used a colorant such as carbon black, titanium black, a magnetic particle including zinc-ferric oxide, nickel-ferric oxide, oil black or the like. Carbon black that has a primary particle diameter of 20 to 40 nm is suitably used since the carbon black having a particle diameter in the range can be dispersed uniformly in a toner and generation of a fog can be reduced.

As the cyan colorant, for example, a copper phthalocyanine compound, a derivative thereof, an anthraquinone compound or the like may be utilized. Specifically, there may be a copper phthalocyanine compound of C. I. Pigment Blue 2, 3, 6, 15, 15:1, 15:2, 15:3, 15:4, 16, 17:1, 60 or the like. Since tinting strength is sufficient and stability upon polymerizing the polymerizable monomer is excellent, the copper phthalocyanine compound of C. I. Pigment Blue 15, 15:1, 15:2, 15:3, 15:4, 17:1 or the like is preferable, more preferably the copper phthalocyanine compound of C. I. Pigment Blue 15:3.

As the yellow colorant, for example, a compound such as an azo based pigment including a monoazo pigment, a disazo pigment or the like, a condensation polycyclic pigment or the like may be used. Specifically, there may be C. I. Pigment Yellow 3, 12, 13, 14, 15, 17, 62, 65, 73, 74, 83, 93, 97, 120, 138, 155, 180, 181, 185, 186 or the like. Since tinting strength is sufficient and stability upon polymerizing the polymerizable monomer is excellent, the monoazo pigment of C. I. Pigment Yellow 3, 15, 65, 73, 74, 97, 120 or the like is preferable.

As the magenta colorant, for example, a compound such as an azo based pigment including a monoazo pigment, a disazo pigment or the like, a condensation polycyclic pigment or the like may be used. Specifically, there may be C. I. Pigment Red 31, 48, 57:1, 58, 60, 63, 64, 68, 81, 83, 87, 88, 89, 90, 112, 114, 122, 123, 144, 146, 149, 150, 163, 170, 184, 185, 187, 202, 206, 207, 209, and 251, C. I. Pigment Violet 19 or the like. Similarly, since tinting strength is sufficient and stability upon polymerizing the polymerizable monomer is excellent, the monoazo pigment of C. I. Pigment Red 31, 48, 57:1, 58, 60, 63, 64, 68, 112, 114, 146, 150, 163, 170, 185, 187, 206, 207 or the like is preferable.

An amount of the colorant is preferably from 1 to 10 parts by weight with respect to the monovinyl monomer contained in the polymerizable monomer of 100 parts by weight.

As other additives, a charge control agent is preferably used. As the charge control agent, various kinds of positive charge control agents or negative charge control agents can be used. For example, there may be used a charge control agent which is not a resin such as a metallic complex of an organic compound having a carboxyl group or nitrogen-containing group, a metallized dye, nigrosine or the like, examples of which includes Spilon Black TRH (manufactured by Hodogaya Chemical Co., LTD.), Bontron S-34 (manufactured by Orient Chemical Industries, LTD.), Bontron E-84 (manufactured by Orient Chemical Industries, LTD.), Bontron N-01 (manufactured by Orient Chemical Industries, LTD.), Copy Blue PR (manufactured by Clariant Corp.) or the like; a charge control resin such as a quaternary ammonium group-containing copolymer, a copolymer containing a group of a quaternary ammonium salt, a sulfonic acid group-containing copolymer, a copolymer containing a group of a sulfonic acid salt, a carboxylic acid group-containing copolymer, a copolymer containing a group of a carboxylic acid salt or the like.

Among them, since printing durability of the toner becomes excellent, the charge control agent containing the charge control resin is preferable. Among the charge control agents, the charge control agent which is not a resin and the charge control resin may be used together, or the charge control resin may be used alone. It is more preferable to use the charge control resin alone. It is further preferable to use the quaternary ammonium group-containing copolymer, the copolymer containing a group of a quaternary ammonium salt, the sulfonic acid group-containing copolymer or the copolymer containing a group of a sulfonic acid salt as the charge control resin.

A ratio of the charge control agent t is preferably from 0.01 to 10 parts by weight, more preferably from 0.03 to 8 parts by weight, with respect to the monovinyl monomer contained in the polymerizable monomer of 100 parts by weight.

Also, as other additives, a molecular weight modifier may be preferably used. As the molecular weight modifier, for example, there may be a mercapto compound such as t-dodecyl mercaptan, n-dodecyl mercaptan, n-octyl mercaptan, 2,2,4,6,6-pentamethylheptane-4-thiol or the like. The molecular weight modifier can be added prior to initiating polymerization or during polymerization.

An amount of the molecular weight modifier may be preferably from 0.01 to 10 parts by weight, more preferably from 0.1 to 5 parts by weight, with respect to the monovinyl monomer contained in the polymerizable monomer of 100 parts by weight.

Furthermore, as other additives, it is preferable to add a release agent since releasing characteristic of a toner from a fixing roll upon fixing can be improved and fixing ability can be increased.

As the release agent, a generally used release agent for a toner can be used without any particular limit. For example, there may be a low-molecular-weight polyolefin wax such as low-molecular-weight polyethylene, low-molecular-weight polypropylene, low-molecular-weight polybutylene or the like; an end-modified polyolefin wax such as a molecular-end-oxidized low-molecular-weight polypropylene, a low-molecular-weight end-modified polypropylene having a molecular end substituted by an epoxy group, a block polymer of the polypropylene and a low-molecular-weight polyethylene, a molecular-end-oxidized low-molecular-weight polyethylene, a low-molecular-weight polyethylene having a molecular end substituted by an epoxy group, a block polymer of the polyethylene and a low-molecular-weight polypropylene or the like; a natural wax such as candelilla, a carnauba wax, a rice wax, a haze wax, jojoba or the like; a petroleum wax such as paraffin, microcrystalline, petrolactam or the like, and a modified wax thereof; a mineral wax such as montan, ceresin, ozokerite or the like; a synthesized wax such as a Fischer-Tropsch wax or the like; an esterified compound of polyalcohol such as pentaerythritol ester including pentaerythritol tetramyristate, pentaerythritol tetrapalmitate, pentaerythritol tetrastearate, pentaerythritol tetralaurate or the like, dipentaerythritol ester including dipentaerythritol hexamyristate, dipentaerythritol hexapalmitate, dipentaerythritol hexalaurate or the like, which may be used alone or in combination of two or more kinds.

Among the above release agents, the esterified compound of polyalcohol such as pentaerythritol ester having a maximum endothermic peak temperature of 30 to 150° C., more preferably 50 to 120° C., and most preferably 60 to 100° C., dipentaerythritol ester having the maximum endothermic peak temperature of 50 to 80° C. or the like is particularly preferable since a toner excellent in fixing-peeling (releasing characteristic) balance upon fixing can be obtained. Herein, a temperature which shows a maximum endothermic peak (maximum endothermic peak temperature) is measured by means of a Differential Scanning Calorimetry (DSC) with reference to ASTM D3418-82 from DSC curve when heated at a heating rate of 10° C./min.

The amount of the release agent may be preferably from 0.1 to 30 parts by weight, more preferably from 1 to 20 parts by weight, with respect to the monovinyl monomer contained in the polymerizable monomer of 100 parts by weight.

It is preferable to add a thiuram disulfide to the polymerizable monomer of the present invention. The thiuram disulfide in the present invention means a compound which has a constitution that S—S is directly bonded with a carbon atom of a thiuram group, represented by the following constitutional formula:

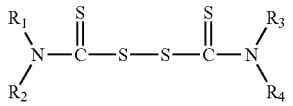

wherein, each $R_1$ to $R_4$ is independently a group which can be selected from the group consisting of a hydrogen atom and an aliphatic, alicyclic or aromatic hydrocarbon group, preferably a hydrogen atom, and an alkyl group, aryl group, alkylaryl group, arylalkyl group or the like having 1 to 9 carbons.

As the compound having the above structure, for example, there may be tetramethylthiuram disulfide, tetraethylthiuram disulfide, tetrabutylthiuram disulfide, N,N'-dimethyl-N,N'-diphenylthiuram disulfide, N,N'-dioctadecyl-N,N'-diisopropylthiuram disulfide or the like.

An amount of the thiuram disulfide may be generally from 0.05 to 2 parts by weight, preferably from 0.1 to 1 part by weight, with respect to the monovinyl monomer contained in the polymerizable monomer of 100 parts by weight. If the amount of the thiuram disulfide is less than the above amount, it is difficult to prevent production of a microparticle as a by-product. On the other hand, if the amount exceeds the above amount, the amount of polymerizable monomer remained in the toner may increase.

The timing of adding the thiuram disulfide may not be limited to the process (A) of preparing a polymerizable monomer composition, but the thiuram disulfide may be added in a process (B) or (C) to be hereinafter described. It is preferable that the thiuram disulfide is added in the process (A) since the thiuram disulfide can be uniformly contained in droplets of the polymerizable monomer composition, the effect of inhibiting production of a by-product microparticle in a toner may be high, and an amount of the remained polymerizable monomer in the toner is small.

(2) Process (B) of Obtaining a Polymerizable Monomer Composition Dispersion

Next, a polymerizable monomer composition obtainable as above is dispersed in an aqueous medium containing a dispersion stabilizer, a droplet of the polymerizable monomer composition is formed, and thus a polymerizable monomer composition dispersion is obtained.

A method of forming the droplet may not be particularly limited. A device capable of high dispersion, for example, an in-line type emulsifying and dispersing machine (product name: MILDER; manufactured by Ebara Corporation), a high-speed emulsifying and dispersing machine (product name: T. K. Homomixer MARK II; manufactured by PRIMIX Corporation) or the like may be used.

In the present invention, the aqueous medium may be solely water, but may be water with a water-soluble solvent. As the water-soluble solvent, there may be alcohol such as methanol, isopropanol, ethylene glycol or the like; dimethylformamide; tetrahydrofuran; low-molecular ketones such as acetone, methyl ethyl ketone or the like.

In the present invention, the dispersion stabilizer is preferably contained in the aqueous medium from the viewpoint of stable dispersion of droplet of the polymerizable monomer composition in an aqueous medium or a colored polymer particle obtained by polymerization thereof, and obtaining a colored polymer particle having a narrow range of distribution of particle size. As the dispersion stabilizer, for example, there may be an inorganic compound such as sulfate including barium sulfate, calcium sulfate or the like, carbonate including barium carbonate, calcium carbonate, magnesium carbonate or the like, phosphate including calcium phosphate or the like, metal oxide including aluminum oxide, titanium oxide or the like, metal hydroxide including aluminum hydroxide, magnesium hydroxide, ferric hydroxide or the like; an organic compound such as a water-soluble polymer including polyvinyl alcohol, methyl cellulose, gelatin or the like, an anionic surfactant, a nonionic surfactant, an ampholytic surfactant or the like. The dispersion stabilizer may be used alone or in combination of two or more kinds.

Among the above dispersion stabilizers, a dispersion stabilizer containing a colloid of the inorganic compound, particularly a hardly water-soluble metal hydroxide, is preferable since a particle size distribution of the colored polymer particle can be narrowed, and a residual amount of the dispersion stabilizer after washing is small so that a polymerized toner to be obtained can sharply reproduce an image and environmental stability of the toner may not be decreased.

An amount of the dispersion stabilizer may be from 1 to 10 parts by weight, preferably from 2 to 7 parts by weight, with respect to the aqueous medium of 100 parts by weight.

In the aqueous medium containing the polymerizable monomer composition and the dispersion stabilizer, generally, a polymerization initiator is contained. The polymerization initiator added to the aqueous medium dissolves into the droplet of the polymerizable monomer composition.

As the polymerization initiator, for example, there may be persulfate such as potassium persulfate, ammonium persulfate or the like; an azo compound such as 4,4'-azobis(4-cyanovaleric acid), 2,2'-azobis(2-methyl-N-(2-hydroxyethyl)propionamide, 2,2'-azobis(2-amidinopropane) dihydrochloride, 2,2'-azobis(2,4-dimethylvaleronitrile), 2,2'-azobisisobutyronitrile or the like; peroxide such as di-t-butylperoxide, benzoylperoxide, t-butylperoxy-2-ethylhexanoate, t-hexylperoxy-2-ethylhexanoate, t-butylperoxypyvalate, diisopropylperoxydicarbonate, di-t-butylperoxyisophthalate, t-butylperoxyisobutyrate or the like. Also, a redox initiator which is a combination of the polymerization initiator and a reducing agent may be used. Among the above, the peroxide may be preferably used since the amount of remained polymerizable monomer can be decreased and resistance of the toner to be obtained is excellent.

After the polymerizable monomer composition is dispersed in the aqueous medium and before forming droplets, the polymerization initiator may be added as mentioned above, but also the polymerization initiator may be added to the polymerizable monomer composition before forming droplets. Preferably, the polymerization initiator is added before forming droplets.

An added amount of the polymerization initiator used for polymerization of the polymerizable monomer composition may be preferably from 0.1 to 20 parts by weight, more preferably from 0.3 to 15 parts by weight, most preferably from 1.0 to 10 parts by weight, with respect to the monovinyl monomer contained in the polymerizable monomer of 100 parts by weight.

(3) Water-soluble Polymerization Inhibitor

In the present invention, the timing of adding a water-soluble polymerization inhibitor may not be particularly limited. The water-soluble polymerization inhibitor may be added in the process (A), (B) or (C). It is preferable that the water-soluble polymerization inhibitor is added to the polymerizable monomer composition dispersion after the process (B) and prior to the process (C), that is, after forming droplets of the polymerizable monomer and before polymerization since the effect to inhibit the amount of the by-product microparticle and the amount of the remained polymerizable monomer is high.

As the water-soluble polymerization initiator, there may not particular limited if it is a polymerization inhibitor which is soluble to the aqueous medium to be used. A water-soluble polymerization initiator which has solubility to water at 15° C. of 0.01 or more, more preferably 0.1 or more, further preferably 1 or more, is preferable. Specifically, there may be a quinone compound such as p-benzoquinone, chloranilic acid, anthraquinone, dichlorobenzoquinone or the like; a hydroxy organic compound such as phenol, tertiary butylcatechol, hydroquinone, catechol, hydroxy monomethyl ether or the like; an amino compound such as methyl aniline, p-phenylenediamine, N,N'-tetraethyl-p-phenylenediamine, diphenylamine or the like; or the like. In the present invention, the water-soluble polymerization initiator may be used alone or in combination of two or more kinds. Among them, the water-soluble polymerization inhibitor particularly preferably used for a method of producing a toner of the present invention is the hydroxy organic compound or the quinone compound. Particularly, the hydroquinone is more preferable.

An amount of the water-soluble polymerization initiator may be preferably from 0.00001 to 0.5 parts by weight, more preferably from 0.05 to 0.25 parts by weight, with respect to the monovinyl monomer contained in the polymerizable monomer of 100 parts by weight. If the amount of the water-soluble polymerization inhibitor is less than the above amount, it is difficult to prevent production of a microparticle as a by-product. On the other hand, if the amount exceeds the above amount, polymerization of the polymerizable monomer composition may be less likely to proceed.

(4) Process (C) of Obtaining a Colored Polymer Particle

The forming droplets of the polymerizable monomer composition is performed followed by addition of the water-soluble polymerization inhibitor as aforementioned, and then the obtained aqueous dispersion medium is heated to initiate polymerization, thereby a colored polymer particle is obtained.

A polymerization temperature of the polymerizable monomer composition may be preferably 50° C. or more, more preferably 50 to 95° C., most preferably from 60 to 95° C. Also, a polymerization reaction time may be preferably from 1 to 20 hours, more preferably from 2 to 15 hours.

The colored polymer particle obtained by polymerization of the polymerizable monomer composition may be used as it is as a polymerized toner or as a polymerized toner by adding an external additive. Also, it is preferable to form a so-called core-shell type (or "capsule type") colored polymer particle, which can be obtained by using the colored polymer particle as a core layer and forming a shell layer, a material of which is different from that of the core layer, around the core layer. The core-shell type colored polymer particle can take a balance of fixing ability (lowering of fixing temperature) and shelf stability (prevention of blocking at storage of a polymerized toner) by covering the core layer comprising a substance having a low-softening point with a substance having a high softening point.

A method for producing the core-shell type colored polymer particle mentioned above may not be particularly limited, and may be produced by a conventional method. An in situ polymerization method and a phase separation method are preferable from the viewpoint of manufacturing efficiency.

The method of producing the core-shell type colored polymer particle according to the in situ polymerization method will be hereinafter described.

A polymerizable monomer (a polymerizable monomer for shell) for forming a shell layer and a polymerization initiator are added to an aqueous medium to which a colored polymer particle is dispersed followed by polymerization, thus the core-shell type colored polymer particle can be obtained.

As the polymerizable monomer for shell, the same polymerizable monomer as aforementioned can be used. Among them, it is preferable to use the monomer which can provide a polymer having Tg of more than 80° C. such as styrene, acrylonitrile, methyl methacrylate or the like alone or in combination of two or more kinds.

As the polymerization initiator for shell used for polymerization of the polymerizable monomer for shell, there may be a water-soluble polymerization initiator such as a metal persulfate including potassium persulfate, ammonium persulfate or the like; a water-soluble azo compound including 2,2'-azobis(2-methyl-N-(2-hydroxyethyl)propionamide), 2,2'-azobis-(2-methyl-N-(1,1-bis(hydroxymethyl)2-hydroxyethyl)propionamide) or the like. An amount of the polymerization initiator for shell may be preferably from 0.1 to 30 parts by weight, more preferably from 1 to 20 parts by weight, with respect to the polymerizable monomer for shell of 100 parts by weight.

A polymerization temperature of the shell layer may be preferably 50° C. or more, more preferably from 60 to 95° C. Also, a reaction time of polymerization may be preferably for 1 to 20 hours, more preferably for 2 to 15 hours.

(5) Filtering, Washing, Dewatering and Drying

The aquesous dispersion of the colored polymer particle obtained by polymerization is preferably subject to filtering, washing (removal of the dispersion stabilizer), dewatering and drying for several times, if necessary, in conventional manner after polymerization.

As a method for washing mentioned above, if an inorganic compound such as metal hydroxide or the like is used as the dispersion stabilizer, it is preferable to add acid or alkali to the aqueous dispersion of the colored polymer particle so as to dissolve the dispersion stabilizer in water and remove. If the colloid of the hardly water-soluble inorganic hydroxide is used as the dispersion stabilizer, it is preferable to add acid so as to adjust pH of the aqueous dispersion of the colored polymer particle to 6.5 or less. As acid to be added, there may be inorganic acid such as sulfuric acid, hydrochloric acid, nitric acid or the like, and organic acid such as formic acid, acetic acid or the like. Inorganic acid is suitable, particularly sulfuric acid, as removing efficiency is high and adverse affect on production facilities is small.

As a method of dewatering and filtering, various known methods or the like can be used and may not be particularly limited.

For example, there may be a centrifugal filtration, a vacuum filtration, a pressure filtration or the like. A method of drying may not be particularly limited, and various methods can be used.

The colored polymer particle or the core-shell type colored polymer particle comprising the polymerized toner of the present invention will be explained (hereinafter, a colored polymer particle includes both core-shell type colored polymer particle and colored polymer particle which is not a core-shell type).

A volume average particle diameter Dv of the colored polymer particle may be preferably from 3 to 15 μm, more preferably from 4 to 12 μm. If Dv is less than the above range, a flowability of the polymerized toner lowers, transferability of the toner may deteriorate, blur may generate in an image to be obtained, or printing density may lower. To the contrary, if Dv exceeds the above range, resolution of an image to be obtained may decline.

A ratio Dv/Dp of a volume average particle diameter Dv and a number average particle size Dp, representing distribution of particle size of the colored polymer particle comprising the polymerized toner of the present invention, may be preferably from 1.0 to 1.3, more preferably from 1.0 to 1.2. If Dv/Dp exceeds the above range, transferability of the toner may decrease, blur may generate in an image to be obtained, and printing density and resolution may decline. Dv and Dp of the colored polymer particle may be measured, for example, by means of a particle diameter distribution measuring device (product name: multicizer; manufactured by Beckman Coulter, Inc.) or the like A sphericity Sc/Sr of the colored polymer particle comprising the polymerized toner of the present invention is preferably from 1.0 to 1.3, more preferably from 1.0 to 1.2. If the sphericity Sc/Sr is over the above range, transferability of the toner may decline, the flowability of the toner may lower, or blur may easily generate. The sphericity Sc/Sr of the colored polymer particle can be obtained as follows. The colored polymer particle is photographed by means of an electron microscope, and thus obtained microgram is measured by means of an image analyzer (product name: LUZEX IID; manufactured by Nireco Corporation) under the condition that the maximum area ratio of particle with respect to frame area is 2% and a total process number of particle is 100. The sphericity of the colored polymer particle can be obtained by averaging the sphericity Sc/Sr of the obtained 100 colored polymer particles.

$$\text{Spheroidicity}=Sc/Sr$$

wherein, Sc is an area of a circle supposing that the absolute maximum length of colored polymer particles is a diameter; and Sr is a substantial projected area of the colored polymer particle.

(6) Polymerized Toner

As a polymerized toner, the colored polymer particle may be used as it is for developing electrophotography. Also, the colored polymer particle, an external additive and other particles may be mixed by means of a high-speed agitator such as a Henshcel mixer or the like to form a one-component polymerized toner in order to control charge property, flowability, shelf stability or the like of a polymerized toner. Further, in addition to the colored polymer particle, the external additive and other particles, if required, a carrier particle such as ferrite, iron powder or the like may be mixed by various known methods to form a two-component polymerized toner. In the present invention, it is more preferable to form a one-component polymerized toner.

As the external additive, generally, there may be an inorganic particle and an organic resin particle used for the purpose of improving fluidity and charge property of the toner, and a particle having smaller particle size than the colored polymer particle may be used. For example, as the inorganic particle, there may be a particle of silica, aluminum oxide, titanium oxide, zinc oxide, tin oxide, calcium carbonate, calcium phosphate, cerium oxide or the like. As the organic resin particle, there may be a particle of a methacrylate polymer, an acrylate polymer, a styrene-methacrylate copolymer, a styrene-acrylate copolymer, a melamine resin or the like, or a core-shell type particle, the core of which is a styrene polymer and the shell of which is a methacrylate polymer, or the like. Among the above, the particle of silica and the particle of titanium oxide may be suitable, a particle of silica or titanium oxide, the surface of which is subjected to a hydrophobicity-imparting treatment, may be more preferable, the particle of silica which is subjected to a hydrophobicity-imparting treatment is most preferable. It is particularly preferable to use two or more kinds of silica which are subjected to the hydrophobicity-imparting treatment together.

An added amount of the external additive may not be particularly limited, but may be generally from 0.1 to 6 parts by weight with respect to 100 parts by weight of the colored polymer particle.

Hereinafter, an image forming device to which the toner of the present invention is applied will be described in reference to drawings.

FIG. 1 shows an example of a constitution of an image forming device to which the polymerized toner of the present invention is applied.

The image forming device as shown in FIG. 1 has a photosensitive dram 1 as a photosensitive member, and the photosensitive dram 1 is mounted so as to be able to rotate freely in the direction of an arrow "A". The photosensitive dram 1 comprises a conductive support dram member and a photoconductive layer provided on the conductive support dram. The photoconductive layer is formed of, for example, an organic photoconductor, a selenium photoconductor, a zinc oxide photoconductor, an amorphous silicon photoconductor or the like. Among them, the organic photoconductor is preferable. The photoconductive layer is bound to the conductive support dram. As a resin used to bind the photoconductive layer to the conductive support dram, for example, there may be a polyester resin, an acrylic resin, a polycarbonate resin, a phenolic resin, an epoxy resin or the like. Among them, the polycarbonate resin is preferable.

Around the photosensitive dram 1 along the circumferential direction thereof, a charging roll 5 as a charging member, a light radiation device 7 as exposure equipment, a development apparatus 21, a transfer roller 9 and a cleaning blade 25 are arranged.

Also, on the downstream side of the conveying direction of the photosensitive dram 1, a fixing device 27 is provided. The fixing device 27 comprises a heating roller 27*a* and a support roller 27*b*.

The conveying route of a transferring material is provided so that the transferring material is conveyed between the photosensitive dram 1 and the transfer roller 9, and between the heating roller 27*a* and the support roller 27*b*.

A method of forming an image with the use of the image forming device as shown in FIG. 1 comprises processes of a charging process, an exposuring process, a developing process, a transferring process, a cleaning process and a fixing process as follows.

The charging process is a process to charge positively or negatively the surface of the photosensitive dram 1 uniformly. As the charging method with the use of the charged member, there may be the charging roll 5 as shown in FIG. 1, and also a contact charging method, which uses a fur brush, a magnetic brush, a blade or the like to charge, and a noncontact charging method, which uses corona discharge. It is possible to replace the charging roll 5 by such a contact charging method or noncontact charging method.

The exposuring process is a process to radiate light corresponding to image signal on the surface of the photosensitive dram 1 by means of the light radiation device 7 as an exposure device as shown in FIG. 1, and to form a latent image of electrostatics on the surface of the photosensitive dram 1 charged uniformly. Such a light radiation device 7 comprises, for example, a radiation apparatus and an optical lens.

The developing process is a process to attach the toner to the latent image of electrostatics formed on the surface of the photosensitive dram 1 in the exposuring process by means the development apparatus 21. The toner is attached only to a light radiated part in the case of reversal, and the toner is attached only to a light non-radiated part in the case of normal development. Thus, the exposuring method and charge polarity of the toner are selected accordingly.

The development apparatus 21 furnished in the image forming device as shown in FIG. 1 is a development apparatus used for a one-component contact developing method, comprising a stirring vane 18, a developing roll 13 and a supply roller 17 in a casing 23 in which a toner 19 is stored.

The stirring vane 18 is furnished in a toner vessel 23*a* formed on the upper stream side of the toner supply direction of the casing 23. The toner 19 is agitated by the stirring vane 18 and flowed.

The developing roll 13 is disposed to partially contact the photosensitive dram 1, and rotates in the direction "B" opposite to the direction of the photosensitive dram 1. The supply roller 17 rotates in the direction "C" similarly to the direction of the developing roll 13 in contact with the developing roll 13. The toner 19 is supplied from the toner vessel 23*a* to the supply roller 17 and is attached to the outer periphery of the supply roller 17. Then, the supply roller 17 supplies the toner 19 to the outer periphery of the developing roll 13. As other developing method, there may be a one-component noncontact developing method, a two-component contact developing method and a two-component noncontact developing method.

At a position on the lower side of the outer periphery of the developing roll 13 between a contact point of the developing roll 13 with the supply roller 17 and a contact point of the developing roll 13 with the photosensitive dram 1, a sealing member 16 is arranged so as to contact the developing roll 13. Also, at a position on the upper side of the outer periphery of the developing roll 13 between the above contact points, a blade 15 for the developing roll as a toner layer thickness controlling member is arranged. The blade 15 for the developing roll forms a thin layer of the toner and charges the toner by friction and/or charge injection. The blade 15 for the developing roll is made of, for example, a conductive rubber elastic body or metal.

The transferring process is a process to transfer the visible image (the image of the toner) formed on the surface of the photosensitive dram 1 by means of the development apparatus 21 to the transferring material 11 such as paper or the like so as to form a transferred image (printed image of the toner). Generally, as shown in FIG. 1, transfer is performed by means of the transfer roller 9. However, besides the transfer roller 9, there may be a belt transfer and a corona transfer.

The cleaning process is a process of cleaning the toner remained on the surface of the photosensitive dram 1. In the image forming device as shown in FIG. 1, the cleaning blade 25 is used.

The cleaning blade 25 may be made of, for example, a rubber elastic body such as polyurethane, an acrylonitrile-butadiene copolymer or the like.

In the image forming device as shown in FIG. 1, after the whole surface of the photosensitive dram 1 is uniformly charged negatively by the charging roll 5, a latent image of electrostatics is formed by means of the light radiation device 7. Further a visible image (an image of the toner) is developed by means of the development apparatus 21. Next, the image of the toner on the photosensitive dram 1 is transferred to the transferring material such as paper or the like by means of the transfer roller 9. The toner not transferred and remained on the surface of the photosensitive dram 1 is cleaned by means of the cleaning blade 25. After that, a new image forming cycle begins.

The fixing process is a process to fix the transferred image (the printed image of the toner) transferred to the transferring material 11. In the image forming device as shown in FIG. 1, at least one of the heating roller 27*a* heated by a heating means (not shown) and the support roller 27*b* is rotated, and the transferring material 11 passes therethrough so as to be heated and pressed.

The image forming device shown in FIG. 1 is an image forming device for monochrome, however, the toner of the present invention can be applied to a color image forming device.

According to the method of producing a polymerized toner of the present invention, since production of the microparticle as a by-product is inhibited and the amount of the polymerizable monomer remained in the colored polymer particle to be obtained is reduced in the polymerization process, the toner which does not generate filming at the time of printing and has excellent printing durability can be obtained.

EXAMPLES

The present invention will be explained further in detail with reference to examples. However, the scope of the present invention may not be limited to the following examples. Herein, "part(s)" and "%" are based on weight if not particularly mentioned.

In the examples, the testing methods performed are as follows.

Samples were subject to a preliminary treatment as follows before measurement of number of by-product microparticle and quantitative determination of remained amount of styrene to be hereinafter described.

pH of a colored polymer particle dispersion after polymerization was adjusted to be in the range of pH 5.5 to 6 by sulfuric acid and kept for 15 minutes. Next, the colored polymer particle dispersion was dewatered by means of a pressure filter and a filter paper (product name: Toyo Roshi No. 2; manufactured by Toyo Roshi Kaisha, Ltd.) until a percentage of moisture content of the colored polymer particle is about 20%.

(1) Measurement of Number of by-Product Microparticle

Samples of obtained colored polymer particles were dried in air on a sample board and observed when enlarged 5,000 times by means of a field emission scanning electron microscope (product name: FE-SEM S4700; manufactured by Hitachi, Ltd.). 20 microscope images (20 microscopic fields) were randomly photographed for each sample. Two colored polymer particle were randomly selected for the obtained 20 images respectively and number of by-product microparticle which can be observed on the surface of the colored polymer particles was calculated. An average number of by-product microparticles calculated from 40 colored polymer particles was referred as number of by-product microparticle.

(2) Quantitative Determination of Remained Amount of Styrene

A remained polymerizable monomer was subject to quantitative analysis for quantitative determination of remained amount of styrene under the following analysis condition.

(Preparation of Sample)

1. A colored polymer particle aquesous dispersion after polymerization was dewatered to obtain a colored polymer particle containing water. The obtained colored polymer particle was precisely weighed down to 10 mg by about 3 g in a 100 ml screw cap glass bottle.

2. 27 g±0.1 g of dimethylformamide was added to the glass bottle and stirred by means of a stirrer to dissolve the colored polymer particle.

3. 13 g±0.1 g of methanol was further added to the glass bottle and continuously agitated for about 10 minutes to precipitate the high molecular weight component dissolved in the above step 2.

4. The agitation was halted and the precipitate was precipitated.

5. A clear top part was removed by means of a syringe. A filter (product name: Menbrane filter 25JP020AN; manufactured by ADVANTEC) was furnished to the syringe to precipitate the precipitate. Thus, a sample liquid was obtained. The sample liquid was analyzed by gas chromatography (GC).

6. Separately, the colored polymer particle containing water obtained by the dewatering of the step 1. was precisely weighted by about 2 g on an aluminum plate having a diameter of 5 cm and dried at 105° C. in an oven for 2 hours. After cooling, the colored polymer particle was weighted to obtain a percentage of solid content.

7. A weight of the dried colored polymer particle (not containing water) was calculated from the weight of the colored polymer particle containing water precisely weighed in the above step 1. and the percentage of solid content obtained in the above step 6.

8. A remained amount of styrene (ppm) of the dried colored polymer particle per unit weight was calculated from the result of GC in the above step 5., the weight obtained in the above step 7. and the calibration curve preliminarily obtained using styrene.

(Analysis Condition)

Device: GC-2010 (product name, manufactured by Shimadzu Corporation)

Column: TC-WAX (product name, manufactured by GL Sciences Inc.), wherein df=0.5 μm, 0.25 mm I. D.×60 m Sensor: FID Carrier gas: helium (linear speed of 21.3 m/sec)

Temperature of inlet: 200° C.

Temperature of sensor: 200° C.

Temperature of oven: 2 minutes at 100° C., raised up to 150° C. at a rate of 5° C./min., and 6 minutes at 150° C.

Sampling amount: 2 μl (3) Printing Durability Test (Generation of Filming and Vertical Stripes)

A commercially available printer (printing speed: 24 prints per minute) of a non-magnetic one-component developing method was used for a printing durability test. A polymerized toner for testing was charged into a developing apparatus of the printer. After leaving the printer at 23° C. in humidity of 50% for one day, 20,000 prints were continuously printed with 1% printing density and filming on a film which is a sealing member between a developing roll and a toner container was visually observed. The results are shown in Table 1 to be hereinafter described. In Table 1, "o" means that no filming was observed and "x" means that filming was observed on a whole surface of the film.

Also, a plain patterned image was printed with 100% printing density every 1,000 prints in the above printing durability test, and generation of vertical stripes was visually observed. Number of printed sheets when a vertical stripe is observed for the first time was referred as number of printed sheets generating vertical stripes.

Example 1

As a monovinyl monomer, 83 parts of styrene and 17 parts of n-butyl acrylate (calculated Tg of copolymer to be obtained=60° C.), 5 parts of C. I. Pigment Blue 15:3 (product name: CTBX121; manufactured by Dainippon Ink & Chemicals, Inc.) as a colorant, 1 part of a charge control agent (styrene/acrylic resin, product name: FCA-207P; manufactured by Fujikurakasei Co., Ltd.), 0.9 parts of divinyl benzene, 1.9 parts of t-dodecyl mercaptan, 0.25 parts of a polymethacrylic acid ester macromonomer (product name: AA6; manufactured by Toagosei Co., Ltd., Tg=94° C.) and 0.5 parts of tetraethylthiuram disulfide (product name: Nocceler TET-G, manufactured by Ouchi Shinko Chemical Industrial Co., Ltd.) were agitated and mixed followed by dispersion by means of a media type dispersing machine, thus obtained a mixture dispersed uniformly. In the mixture, 5 parts of dipentaerythritol hexamyristate (solubility is 10 g or more in 100 g of styrene, maximum endothermic peak temperature of 65° C., molecular weight of 1,514) was added as a release agent and dissolved, thus obtained a polymerizable monomer composition.

Separately, an aqueous solution of 4.8 parts sodium hydroxide dissolved in 50 parts of ion-exchanged water was gradually added into an aqueous solution of 8.6 parts magnesium chloride dissolved in 250 parts of ion-exchanged water while agitated at room temperature. Thereby, a magnesium hydroxide colloid (hardly water-soluble metal hydroxide colloid) dispersion liquid 1 was prepared.

The polymerizable monomer composition was charged into thus obtained magnesium hydroxide colloid dispersion liquid 1 and agitated. Thereto, as a polymerization initiator, 5 parts of t-butylperoxy-2ethylhexanoate (product name: PERBUTYL O; manufactured by Nihon Yushi Co., Ltd.) was added. Thereafter, a high shear stirring was performed at 15,000 rpm for 10 minutes by means of an in-line type emulsifying and dispersing machine (product name: MILDER; manufactured by Ebara Corporation) to form droplets of the polymerizable monomer composition, thus obtained an aqueous dispersion of the polymerizable monomer composition.

Further separately, an aqueous solution of 0.92 parts sodium hydroxide (alkali metal hydroxide) dissolved in 7.93 parts of ion-exchanged water was gradually added into an aqueous solution of 1.51 parts magnesium chloride dissolved in 39.64 parts of ion-exchanged water while agitated at room temperature. Thereby, 50 parts of a magnesium hydroxide colloid dispersion liquid 2 (3.9 parts of hardly water-soluble metal hydroxide colloid with respect to water of 100 parts) was prepared. Thus obtained magnesium hydroxide colloid dispersion liquid 2 was sprayed on an inner surface of the reactor and a stirring vane.

The aqueous dispersion of the droplets of the polymerizable monomer composition was charged into the reactor from the top. The magnesium hydroxide colloid dispersion liquid 2 gathered on the bottom of the reactor reduced the impact on the falling polymerizable monomer composition. In the reactor, 0.1 part of a 5 wt % hydroquinone aqueous solution in terms of the hydroquinone calibration was added. The temperature of the reactor was raised to 90° C. to polymerize. When a polymerization conversion rate reached 95%, 1 part of methyl methacrylate as a polymerizable monomer for shell and 0.1 parts of a water-soluble polymerization initiator (product name: VA086; manufactured by Wako Pure Chemical Industries, Ltd.) dissolved in 10 parts of ion-exchanged water as a polymerization initiator for shell were added. Polymerization was further continued for 3 hours followed by cooling to room temperature, thus obtained an aqueous dispersion of a colored polymer particle having pH 9.5.

The aqueous dispersion of the colored polymer particle was subject to acid washing in which sulfuric acid was added to be pH 4 or less. After dewatering by filtrating, ion-exchanged water was added again by 500 parts to make a slurry followed by washing with water. Thereafter, similarly, dewatering and washing with water was repeated for several times. After dewatering by filtrating, vacuum drying was performed, thus obtained a dried colored polymer particle.

The volume average particle diameter Dv of the dried colored polymer particle was 9.5 μm and Dv/Dp (volume average particle diameter/number average particle size) was 1.16.

As external additives, 0.8 parts of a silica particle subjected to a hydrophobicity-imparting treatment (a primary particle diameter of 7 mm) and 1.0 part of a silica particle subjected to a hydrophobicity-imparting treatment (a primary particle diameter of 30 mm) were added to 100 parts of thus obtained colored polymer particle, and mixed by means of a Henschel mixer, thereby, a non-magnetic one-component polymerized toner was prepared.

Example 2

In the same manner as Example 1 except that the added amount of tetraethylthiuram disulfide was changed from 0.5 parts to 0.2 parts, a polymerized toner was prepared.

Comparative Example 1

In the same manner as Example 1 except that 0.5 parts of tetraethylthiuram disulfide was not added, a toner was prepared.

Comparative Example 2

In the same manner as Example 1 except that 0.5 parts of tetraethylthiuram disulfide was not added and the added amount of hydroquinone was changed from 0.1 parts to 0.6 parts, a toner was prepared.

Comparative Example 3

In the same manner as Example 1 except that 0.1 part of hydroquinone was not added, a toner was prepared.

Comparative Example 4

In the same manner as Example 1 except that 0.5 parts of tetraethylthiuram disulfide was not added, and 0.1 part of hydroquinone was agitated and mixed together with 83 parts of styrene and 17 parts of n-butyl acrylate (monovinyl monomer), 5 parts of C. I. Pigment Blue 15:3 (colorant), 1 part of a charge control agent, 0.9 parts of divinyl benzene, 1.9 parts of t-dodecyl mercaptan and 0.25 parts of a polymethacrylic acid ester macromonomer followed by dispersion by means of the media type dispersing machine to uniformly disperse in the process of obtaining the polymerizable monomer composition instead of adding 0.1 part of a 5% hydroquinone aqueous solution to the polymerizable monomer composition dispersion before the polymerization reaction, a toner was prepared.

[Results]

The characteristics, image or the like of the toners obtained in each Examples and Comparative examples were examined in the aforementioned methods. The results are shown in Table 1.

[Summary of the Results]

The results of the printing durability tests (filming and number of printed sheets when a vertical strip is generated) of the toners containing tetraethylthiuram disulfide and hydroquinone obtained in Examples 1 and 2 were excellent since generation of remained styrene and number of by-product microparticle were inhibited.

To the contrary, the results of the printing durability tests of the toner not containing tetraethylthiuram disulfide and containing 0.1 part of hydroquinone obtained in Comparative example 1 was not preferable since the number of by-product microparticle was larger than that of Examples 1 and 2.

The toner not containing tetraethylthiuram disulfide and containing 0.6 parts of hydroquinone obtained in Comparative example 2 could inhibit production of by-product microparticle due to increased compounding amount of the hydroquinone, however, the amount of remained styrene increased. As for the results of printing durability tests of Comparative example 2, filming of a by-product microparticle was not generated on the film, however, printing durability was insufficient since the amount of remained styrene is large and therefore filming of the particle of the toner was likely to generate filming on the photosensitive member and the developing blade.

The results of the printing durability tests of the toner containing 0.5 parts of tetraethylthiuram disulfide and not containing hydroquinone obtained in Comparative example 3 was not preferable since the remained amount of styrene was inhibited, however, number of by-product microparticle was large.

TABLE 1

| | TET*1 | HQ*2 | | Remained | Number of by- | Printing durability test | |
|---|---|---|---|---|---|---|---|
| | (part by weight) | Timing of addition | (part by weight) | styrene (ppm) | product microparticle | Filming | Number of printed sheets when a vertical stripe is generated |
| Example 1 | 0.5 | Before polymerization reaction | 0.1 | 296 | 1 | ○ | Not generated after printing 20,000 prints |
| Example 2 | 0.2 | Before polymerization reaction | 0.1 | 276 | 4 | ○ | Not generated after printing 20,000 prints |
| Comparative example 1 | 0 | Before polymerization reaction | 0.1 | 229 | 300 or more | x | 6,000 |
| Comparative example 2 | 0 | Before polymerization reaction | 0.6 | 1,520 | 8 | ○ | 8,000 |
| Comparative example 3 | 0.5 | Before polymerization reaction | 0 | 180 | 300 or more | x | 4,000 |
| Comparative example 4 | 0 | Process of preparing polymerizable monomer composition | 0.1 | 288 | 300 or more | x | 7,000 |

*1TET: tetraethylthiuram disulfide

*2HQ: hydroquinone

The results of the printing durability tests of the toner not containing tetraethylthiuram disulfide and in which the timing to add hydroquinone was changed from after obtaining the aqueous dispersion of the polymerizable monomer composition to during the process of obtaining the polymerizable monomer composition obtained in Comparative example 4 was not preferable since number of by-product microparticle was large.

What is claimed is:

1. A method of producing a polymerized toner comprising the steps of:

(A) preparing a polymerizable monomer composition containing at least a polymerizable monomer and a colorant;

(B) obtaining a polymerizable monomer composition dispersion by adding the polymerizable monomer composition in an aqueous medium containing a dispersion stabilizer, thereby to form droplets of the polymerizable monomer composition; and (C) obtaining a colored polymer particle by heating the polymerizable monomer composition dispersion to polymerize the polymerizable monomer composition, wherein the polymerizable monomer composition dispersion contains a water-soluble polymerization inhibitor and a thiuram disulfide.

2. The method of producing the polymerized toner according to claim 1, wherein the water-soluble polymerization inhibitor is a hydroquinone.

3. The method of producing the polymerized toner according to claim 1, wherein an amount of the water-soluble polymerization initiator is from 0.00001 to 0.5 parts by weight with respect to the monovinyl monomer contained in the polymerizable monomer of 100 parts by weight.

4. The method of producing the polymerized toner according to claim 1, wherein the polymerizable monomer composition contains the thiuram disulfide.

5. The method of producing the polymerized toner according to claim 1, wherein the thiuram disulfide is represented by the following constitutional formula, in which each $R_1$ to $R_4$ is independently selected from the group consisting of a hydrogen atom, and an alkyl group, aryl group, alkylaryl group, arylalkyl group or the like having 1 to 9 carbons:

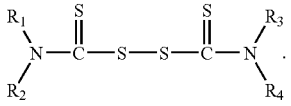

6. The method of producing the polymerized toner according to claim 1, wherein an amount of the thiuram disulfide is from 0.05 to 2 parts by weight with respect to the monovinyl monomer contained in the polymerizable monomer of 100 parts by weight.

7. The method of producing the polymerized toner according to claim 1, wherein the water-soluble polymerization inhibitor is added to the polymerizable monomer composition dispersion after the step (B) and before the step (C).

8. The method of producing the polymerized toner according to claim 1, wherein the dispersion stabilizer is a dispersion stabilizer containing a colloid of a hardly water-soluble metal hydroxide.

9. The method of producing the polymerized toner according to claim 1, wherein the aqueous medium containing the polymerizable monomer composition and the dispersion stabilizer contain a polymerization initiator.

10. The method of producing the polymerized toner according to claim 1, wherein a polymerization temperature of the polymerizable monomer composition is 50 to 95° C. and a polymerization reaction time is from 1 to 20 hours in the step (C).

11. The method of producing the polymerized toner according to claim 1, wherein the colored polymer particle is used as a core layer, and a shell layer, a material of which is different from that of the core layer, is formed around the core layer so as to form a colored polymer particle having a core-shell structure.

* * * * *